US006585879B2

(12) United States Patent
Ilgar

(10) Patent No.: US 6,585,879 B2
(45) Date of Patent: Jul. 1, 2003

(54) ALUMINUM ELECTROLYSIS USING SOLID CRYOLITE/ALUMINA CRUST AS ANODE

(76) Inventor: Ersan Ilgar, 7554 Chardon Rd., Kirtland, OH (US) 44094

( * ) Notice: Subject to any disclaimer, the term of this patent is extended or adjusted under 35 U.S.C. 154(b) by 51 days.

(21) Appl. No.: 09/930,542

(22) Filed: Aug. 15, 2001

(65) Prior Publication Data

US 2003/0034253 A1 Feb. 20, 2003

(51) Int. Cl.[7] ..... C25C 3/12; C25C 3/06

(52) U.S. Cl. ..... 205/385; 205/372; 205/380; 205/387

(58) Field of Search ..... 205/372, 380, 205/385, 387

(56) References Cited

U.S. PATENT DOCUMENTS

| | | | | |
|---|---|---|---|---|
| 3,236,753 A | | 2/1966 | Skantze | |
| 3,787,300 A | | 1/1974 | Johnson | |
| 3,787,310 A | | 1/1974 | Johnson | |
| 4,219,391 A | * | 8/1980 | Foster, Jr. | 205/375 |

* cited by examiner

*Primary Examiner*—Nam Nguyen
*Assistant Examiner*—Brian L Mutschler
(74) *Attorney, Agent, or Firm*—William L. Krayer

(57) ABSTRACT

A solid cryolite/alumina mixture is used as the anode in an electrolytic aluminum winning process. The mixture may be used in the form of a crust formed on the electrolytic cell.

14 Claims, 1 Drawing Sheet

ALUMINUM ELECTROLYSIS USING SOLID CRYOLITE/ALUMINA CRUST AS ANODE

TECHNICAL FIELD

An electrolytic cell and process for winning aluminum from alumina in which a crust of cryolite and alumina is used as an electrode.

BACKGROUND OF THE INVENTION

For over a century, the Hall-Heroult electrolytic cell has been used for making aluminum from alumina. Virtually universally, the electrolyte includes cryolite ($Na_3AlF_6$) along with the alumina, and the anodes are made of a high percentage of carbon.

A succinct description of the basic process is found in column 1, lines 35–46 of Dell's U.S. Pat. No. 3,303,119: "In operation, a mixture of alumina and cryolite (usually with one or more other fluorides) is provided in the cell cavity, and an electric current is passed through the cell. The resistance of the alumina-cryolite charge to the passage of current produces sufficient heat to fuse the same, and form a molten electrolyte or bath, which may then be considered as a solution of alumina in molten cryolite, Aluminum is electrolyzed from the solution, depositing as a molten layer on the cathode, while oxygen passes to the anode. A crust of frozen electrolyte forms on the surface of the bath (which is usually at a temperature of about 970° C.) and this crust is usually covered over with some undissolved alumina." Also, "Operating data confirm that approximately 0.4 pound of carbon per pound of aluminum metal produced is necessarily consumed in this manner . . . As the anode carbon is consumed, the anode is lowered into the bath by mechanical or automatic means" (column 1, lines 53–61).

Anodes made of various carbon compositions are widely used in the cells, but have several significant disadvantages.

Carbon monoxide and carbon dioxide formed around the carbon anodes tend to block and reduce the passage of current to the anode. In turn, this increases the voltage of the current that passes through the anode, which may cause the formation of toxic gases such as fluorine, carbon tetrafluoride, $C_2F_4$, and hydrogen fluoride. This highly undesirable phenomenon is commonly known as the "anode effect."

Carbon anodes are often made from carbon sources and binders from the byproducts of coke production or other coal processes, such as tar and pitch, which are environmentally difficult materials to work with. Large numbers of anodes are used at any given time in the aluminum industry. Since they are consumed in the aluminum production process, they must be replaced frequently, which means the sheer quantity of raw material and finished anode product is an environmental problem.

In addition, the manufacture of carbon anodes is labor intensive and expensive. Because of the cost of the anodes, the spent "butts" are reused, but the reuse of the butts requires washing and other treatment which results in a waste water stream containing such toxic materials as cyanide, benzene, toluene, and other organics found in tars and pitch.

Rapp, in U.S. Pat. No. 6,039,862, points out as an additional disadvantage of carbon electrodes the generation of "greenhouse gas," and alludes to a search for a non-consumable electrode. He estimates the cost of consumable carbon anodes amounts to 14.4% of the cost of producing aluminum.

In U.S. Pat. No. 3,787,310, Johnson reviews the previous patent literature on coating and impregnating carbon anodes in order to reduce erosion of the anodes. He relates that it has been common in the past to splatter molten bath on parts of the anode, and to dust cryolite powder on the red hot anodes, to which it will adhere. He proposes coating an otherwise more or less conventional carbon anode with cryolite. See also Johnson's U.S. Pat. No. 3,787,300 and Skantze et al U.S. Pat. No. 3,236,753, describing an "impermeable" coating of cryolite including an excess of aluminum fluoride and a minor amount of alumina, used to protect a carbon anode against erosion in the cell. In Example 1 of the Skantze et al patent (issued in 1966), it is said that, although the coating appeared to be generally beneficial, "the side coating peeled off because the coating fused to the crust of electrolyte on top of the molten bath of electrolyte in the cell."

The aluminum industry consumes large quantities of power, which subjects it to criticism for pollution incident to electrical power generation as well as its own contributions inevitable in the use of carbon anodes. This invention provides a way to eliminate the carbon anodes.

SUMMARY OF THE INVENTION

I have invented a process for the electrolytic manufacture of aluminum which does not require the use of a carbon anode. Briefly, my process uses solid cryolite/alumina as the anode in contact with the molten cryolite/alumina electrolyte.

The normal operation of my process is similar to conventional processes in one aspect, that a cryolite/alumina mixture is subject to an electric current and aluminum is separated at the cathode. The cathode may be any conventional material or metal and is situated in the bottom of the cell as is conventional. In another, major, aspect, however, it is quite different in that there is no carbon anode. The anode is solid cryolite or a solid cryolite/alumina mixture. This solid anode comprising cryolite is connected to the power system by a metallic connector—that is, a conductive metal such as steel, cast iron, or titanium.

To begin the process, a piece of solid cryolite or cryolite/alumina is connected to the power by a metallic connector.

DETAILED DESCRIPTION OF THE INVENTION

Figure 1:
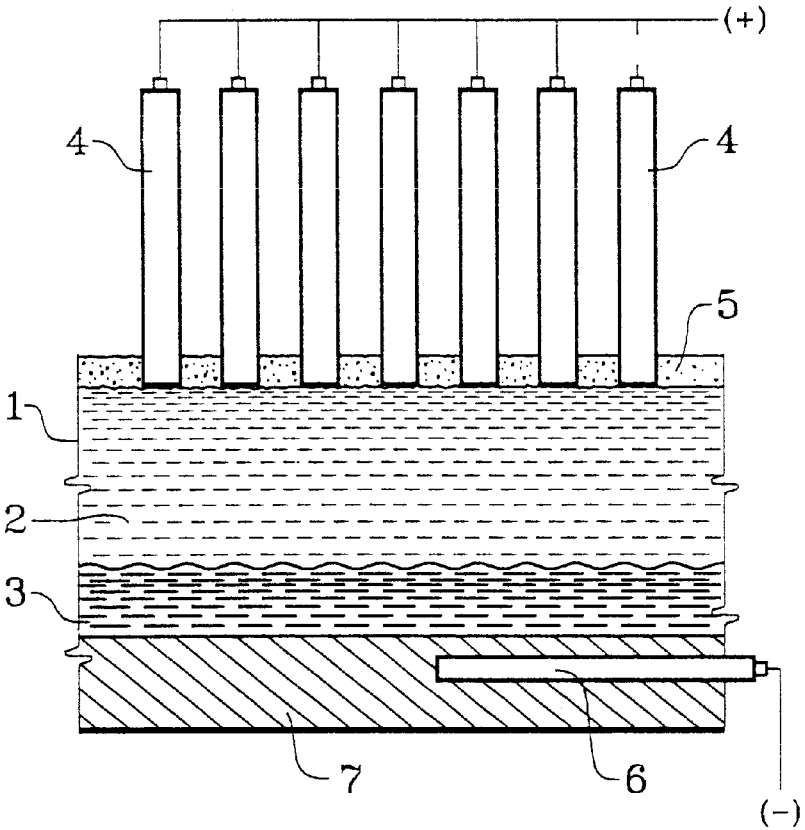
Fig. 1 PRIOR ART
FIG. 1 is an idealized section of an electrolytic cell of the prior art.

Referring now to FIG. 1, the prior art generally utilizes a cell 1 containing a steel bar 6 in carbon cathode 7. During normal operation, a cryolite/alumina electrolyte 2 is subjected to a current sufficient to maintain the electrolyte in a liquid state. The current flows to carbon anodes 4, resulting in the separation of molten aluminum metal 3. The generation of oxygen at the anode facilitates the formation of cryolite/alumina crust 5. Formation of the cryolite/alumina crust 5 is to be expected.

Figure 2:
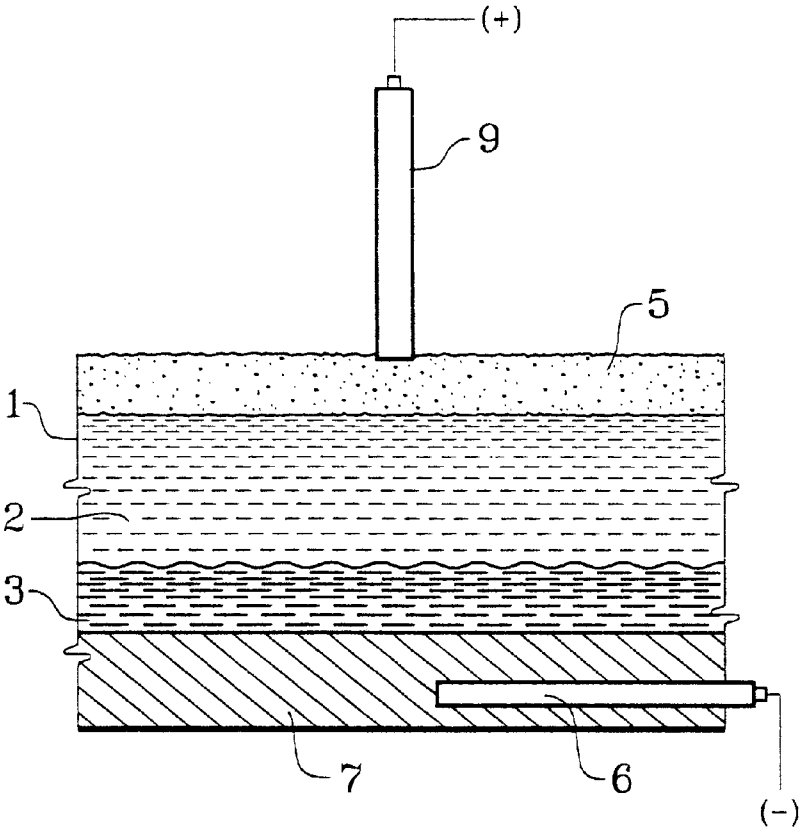
FIG. 2 is an idealized section of my electrolytic cell using cryolite as the anode.

FIG. 2 depicts the normal operation of my process, in which the cell 1, carbon cathode 7, cryolite/alumina electrolyte 2, and molten aluminum 3 are disposed similar to the conventional process in FIG. 1. The terminal 9, however, is not carbon, and may be any metal known to be useful for connecting a carbon anode as in FIG. 1, preferably steel or titanium. Also different is the function of cryolite crust 5 as the anode. The temperature is 800–1000° C., imparted entirely by resistance to the high current, which should be at least 200 kA per cell, preferably 225 kA to 275 kA and may be as high as 300 kA or higher. In normal operation, crust 5 covers the entire surface of the molten electrolyte 2. There should be at least one terminal 9 for every three square meters of crust 5; preferably there will be one terminal for each square meter of the cell. In a rectangular cell 3.3 meters wide and ten meters long, for example, from ten to twenty terminals, or as many as 30 or more, may be used. Somewhat more or fewer terminals may be used within the operator's discretion, depending on variables such as the electric current, depth of the cell, operating temperature, and the like.

To initiate the process, a mixture is prepared of cryolite and alumina in proportions conducive to making molten aluminum as is known in the art. I prefer a composition comprising 80–90% cryolite ($Na_3AlF_6$), 2–6% alumina ($Al_2O_3$), 5–10% $AlF_3$, up to 5% CaF, up to 4% $MgF_2$, and up to 4% LiF.

At the beginning of the process, the anode "starter crust" may be thin. However, the thickness will increase over time in a steady state condition so that all of the metal electrodes can contact the crust. When the current is applied for electrolysis, this crust will act as the anode while the crust will electrochemically redissolve and simultaneously reform due to oxidation from the air occurring at the surface. At the same time, some alumina from the crust has been introduced into the bath. The loss of alumina from the crust is replenished by adding alumina on the top of the crust to maintain about 2–6% alumina in the crust and bath. The solid crust, a mixture of alumina and cryolite, will serve as the anode for the aluminum electrolysis process. As with conventional processes, the molten metallic aluminum is continuously or intermittently siphoned from the bottom of the cell, and the bath is continuously or intermittently replenished with alumina by breaking through the crust and inserting the alumina.

Alternatively, the process may be initiated by separately heating a mixture of alumina and cryolite to melt it, and pouring it into the cell. Crust will begin to form on the entire surface, and the operator may then contact the crust with several terminals at once, preferably one terminal for each square meter(s) of crust. In this manner, use of a single terminal is avoided, and full power may be used from the beginning of the application of current to the cell.

What is claimed is:

1. Method of making aluminum comprising electrolyzing a molten electrolyte mixture of alumina and cryolite in a cell comprising a cathode and an anode, wherein said anode comprises a solid cryolite/alumina electrode mixture in the form of a crust residing on top of said molten electrolyte mixture.

2. Method of claim 1 wherein said mixture of alumina and cryolite is liquid at a temperature of 950 to 1050° C.

3. Method of claim 1 wherein said anode comprises from 80% to 90% cryolite and 2% to 6% alumina.

4. Method of claim 1 wherein said anode is connected to a power circuit by at least one metallic terminal for each square meter of said crust.

5. Method of claim 1 including controlling the temperature of said mixture at a temperature of 800 to 1050° C.

6. Method of claim 1 wherein said temperature is controlled within 920 to 1020° C.

7. A continuous method of making aluminum comprising forming a mixture comprising cryolite and alumina, placing said mixture in an electrolytic cell having a carbon cathode and a solid anode, said solid anode comprising cryolite in the form of a crust residing on top of said mixture, electrolyzing said mixture to form molten aluminum, and continuously or intermittently draining or siphoning said aluminum from said cell.

8. Method of claim 7 wherein said crust includes alumina.

9. Method of claim 8 wherein said alumina in said crust continuously or intermittently is introduced into said mixture comprising cryolite and alumina, and is continuously or intermittently replenished.

10. Method of claim 9 wherein said alumina is replenished by adding alumina to the top of said crust.

11. Method of claim 9 wherein said alumina is replenished by breaking through said crust and inserting said alumina.

12. Method of claim 7 wherein said mixture comprising cryolite and alumina includes 80–90% $Na_3AlF_6$, 2–6% $Al_2O_3$, 5–10% $AlF_3$, up to 5% CaF, up to 4% $MgF_2$, and up to 4% LiF.

13. Method of claim 8 wherein said crust is contacted with at least one metallic terminal.

14. Method of making aluminum comprising forming a mixture comprising cryolite and alumina, placing said mixture in an electrolytic cell having a carbon cathode and solid anode, said solid anode consisting essentially of 80–90% $Na_3AlF_6$, 2–6% $Al_2O_3$, 5–10% $AlF_3$, up to 5% CaF, up to 4% $MgF_2$, and up to 4% LiF in the form of a crust residing on top of said mixture, electrolyzing said mixture to form molten aluminum, and continuously or intermittently draining or siphoning said aluminum from said cell.

* * * * *